US005339885A

United States Patent [19]

Sinden et al.

[11] Patent Number: 5,339,885

[45] Date of Patent: Aug. 23, 1994

[54] INTEGRATED NON-CONTACT MOLTEN METAL LEVEL SENSOR AND CONTROLLER

[75] Inventors: A. David Sinden, Spokane; Hans Fischer, Mead; Roy V. Twining, Liberty Lake, all of Wash.

[73] Assignee: Wagstaff Inc., Spokane, Wash.

[21] Appl. No.: 58,909

[22] Filed: May 7, 1993

[51] Int. Cl.[5] ..... B22D 37/00; B22D 41/20

[52] U.S. Cl. ..... 164/450.4; 164/150.1; 164/151.2; 324/202; 324/207.26

[58] Field of Search ..... 164/150, 154, 449, 450, 164/453; 374/1; 324/202, 204, 207.16, 207.26, 601

[56] References Cited

U.S. PATENT DOCUMENTS

| | | | |
|---|---|---|---|
| 4,030,027 | 6/1977 | Yamada et al. . | |
| 4,186,792 | 2/1980 | Yamada et al. | 164/449 |
| 4,498,521 | 2/1985 | Takeda et al. | 164/453 |
| 4,555,941 | 12/1985 | Fathauer et al. | 324/601 |
| 4,567,435 | 1/1986 | Yamada et al. | 324/207.26 |
| 4,567,935 | 2/1986 | Takeda et al. | 164/450 |
| 4,624,139 | 11/1986 | Collins | 324/601 |
| 4,647,854 | 3/1987 | Tamada et al. | 164/449 |
| 4,912,407 | 3/1990 | Gualtieri et al. | 324/204 |
| 5,059,902 | 10/1991 | Linder | 324/204 |
| 5,088,325 | 2/1992 | Eichberger et al. | 324/601 |

FOREIGN PATENT DOCUMENTS

| | | | |
|---|---|---|---|
| 0211955 | 8/1990 | Japan | 164/150 |
| 0027854 | 2/1991 | Japan | 164/449 |

*Primary Examiner*—P. Austin Bradley
*Assistant Examiner*—Erik R. Puknys
*Attorney, Agent, or Firm*—Wells, St. John, Roberts, Gregory & Matkin

[57] ABSTRACT

A metal casting control device is provided for use in conjunction with a semi-continuous metal casting system. The control device is an integral module containing a metal surface elevation sensing device, a valve actuator for positioning a metal distribution control valve, and electronic circuits associated with these mechanical components. The control device module is adapted to be connected to an overhead metal distribution launder by a single quick-coupling for convenient and simple removal and replacement. Calibration of the control device is performed after installation by mounting a calibration target on the metal casting system and vertically adjusting the metal surface elevation sensing device until an integral calibration indicator positioned on the control device indicates that the proper vertical position has been attained. The metal surface elevation sensing device is formed by a manually-adjustable sensor carriage and a sensor support which is mounted for automatic vertical movement relative to the sensor carriage. An inductive proximity sensor is supported over a metal casting station by the sensor support. The vertical position of the sensor support is controlled to maintain the sensor within a fixed vertical distance from the surface of molten metal within the metal casting station.

61 Claims, 8 Drawing Sheets

INTEGRATED NON-CONTACT MOLTEN METAL LEVEL SENSOR AND CONTROLLER

TECHNICAL FIELD

This invention relates to automated equipment and methods for measuring and controlling molten metal surface elevation in continuous metal casting stations.

BACKGROUND OF THE INVENTION

Continuous and semi-continuous aluminum billet and ingot casting has become increasingly automated with the availability of computer-controlled casting machines. Conventional EM (electromagnetic) or DC (direct chill) aluminum casting typically involves controllably discharging molten aluminum to one or more semi-continuous casting stations. Each casting station includes a concave bottom block and a surrounding mold. The mold can be either a DC mold or an EM mold. In either case, casting is performed by discharging aluminum onto the bottom block and gradually lowering the bottom block while cooling the mold and the lower portions of the cast aluminum.

Various factors are responsible for the quality of the resulting ingot. Generally, three variables must be closely monitored and controlled to achieve optimum results: molten metal surface level or surface elevation, casting rate, and cooling rate. At one time these parameters were monitored and controlled by skilled human operators. The quality of the resulting ingots or billets varied with the skill and experience of the operators. A very skilled operator was capable of producing excellent and repeatable results. However, quality would vary from shift to shift, and between casting machines. Furthermore, even skilled operators would make occasional mistakes.

In order to eliminate the inconsistencies and unpredictable results of operator-controlled casting, modern casting machines are controlled almost exclusively by computer. Various sensors provide information as casting proceeds so that the three variables noted above can be changed on-the-fly as conditions warrant. Typically, a casting "practice" is programmed into the computer to establish desired parameter profiles for molten metal level, casting rate, and cooling rate. This "practice" is repeated during every cast, so that results are repetitively consistent.

A typical semi-continuous casting system includes a number of individual casting stations. Each casting station has a bottom block and a surrounding mold. The bottom blocks of each casting station are mounted in a row to a common table or support structure, and are dropped at the same rate during casting.

A molten metal distribution launder spans the casting stations. The launder has a number of valved downspouts which are controlled to maintain desired elevations of molten metal within the casting station molds. Some type of sensor, such as a float sensor, is associated with each casting station to determine the actual surface elevation of molten metal within the casting station. Other sensors are provided to monitor other needed parameters, such as temperature and coolant flow rates.

It is convenient to mount molten metal flow control components and associated metal surface elevation sensors from the overhead molten metal distribution launder. This is because of the need for unobstructed access to the metal casting stations from above after casting is completed. The molten metal distribution launder is removed from above the casting stations after casting, taking with it the various components which monitor and control metal flow into the casting stations.

U.S. Pat. No. 4,498,521, to Takeda et al., describes such an apparatus where metal flow components are supported from an overhead metal distribution launder. The Takeda patent describes a float sensor which is supported from a metal distribution launder, as well as a control pin which is positioned by an independently-mounted rotary actuator to control metal flow rates into the underlying casting station. Coordination between the float sensor and the rotary actuator is accomplished by an external controller. In many systems, the external controller is remotely located relative to the casting system. The Takeda system allows control over the surface level of molten metal within the underlying casting stations throughout a cast.

Despite the many advantages of an automated system, complexity can lead to certain disadvantages. One such disadvantage is the unreliability of "high-tech" components—particularly when subjected to the extremely high temperatures of a metal casting system. Another disadvantage is that complex systems often require complex calibration adjustments. In a system such as described by the Takeda patent, it is necessary to calibrate the system so that the float sensor produces an output signal which is meaningful to the external controller. This is accomplished in most systems by an electronic adjustment associated with the float sensor. It could also conceivably be accomplished by altering the programming of the external controller. Either procedure introduces an opportunity for error. Furthermore, both procedures require repeated references by human operator to the sensor itself, located over the casting station, and to the external controller, usually located at some distance from the casting station.

The invention below addresses the disadvantages which have resulted from automation of casting systems. It simplifies the installation, repair, and calibration of molten metal surface elevation control systems while also greatly improving the reliability of such control systems.

BRIEF DESCRIPTION OF THE DRAWINGS

A preferred embodiment of the invention is described below with reference to the accompanying drawings, among which:

FIG. 5 is a perspective view of a top portion of the metal casting control device of FIG. 1;

DETAILED DESCRIPTION OF THE PREFERRED EMBODIMENT

Figure 1:
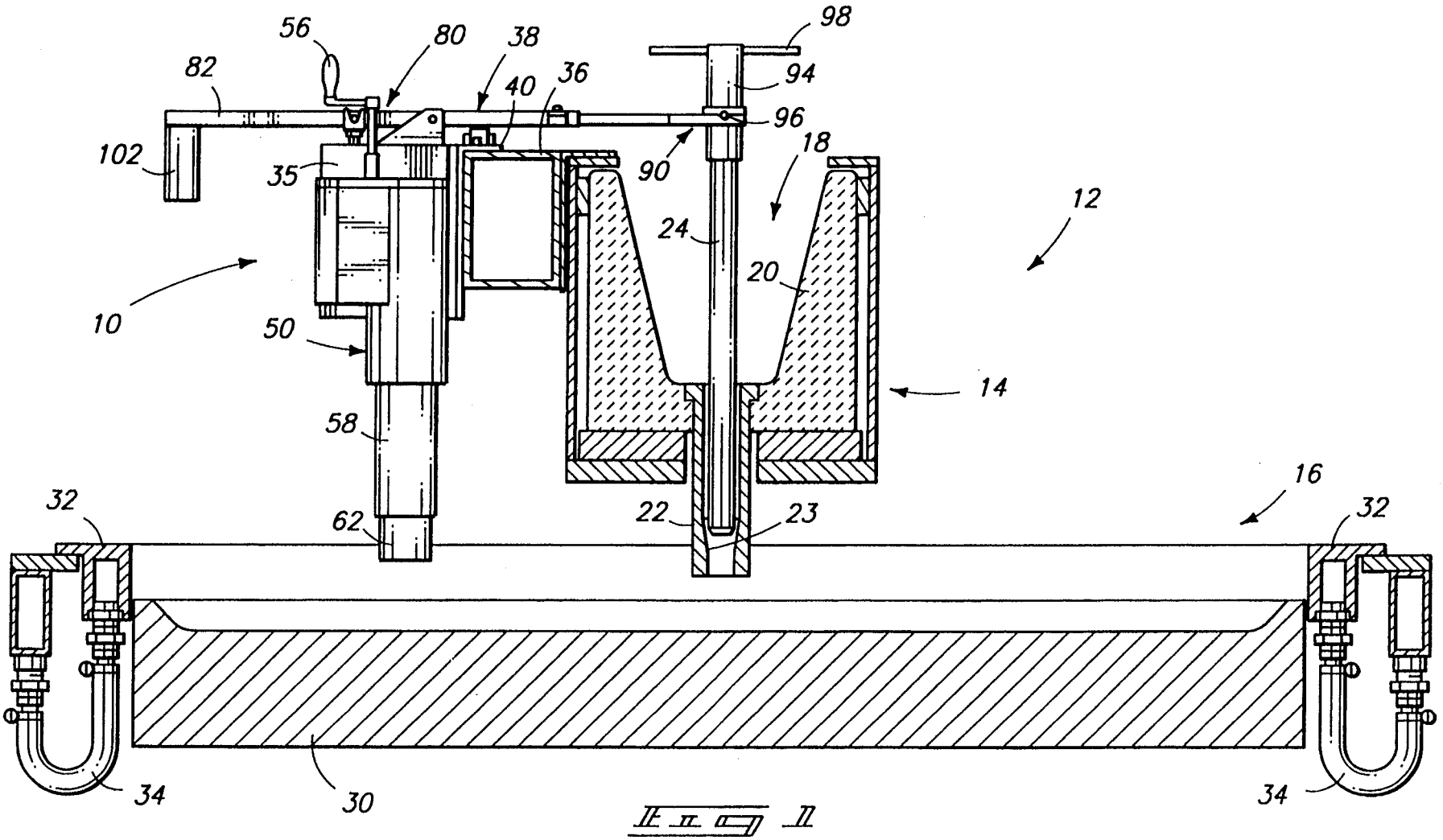
FIG. 1 is a cross-sectional view of a semi-continuous metal casting system and a metal casting control device in accordance with a preferred embodiment of the invention.
Figure 2:
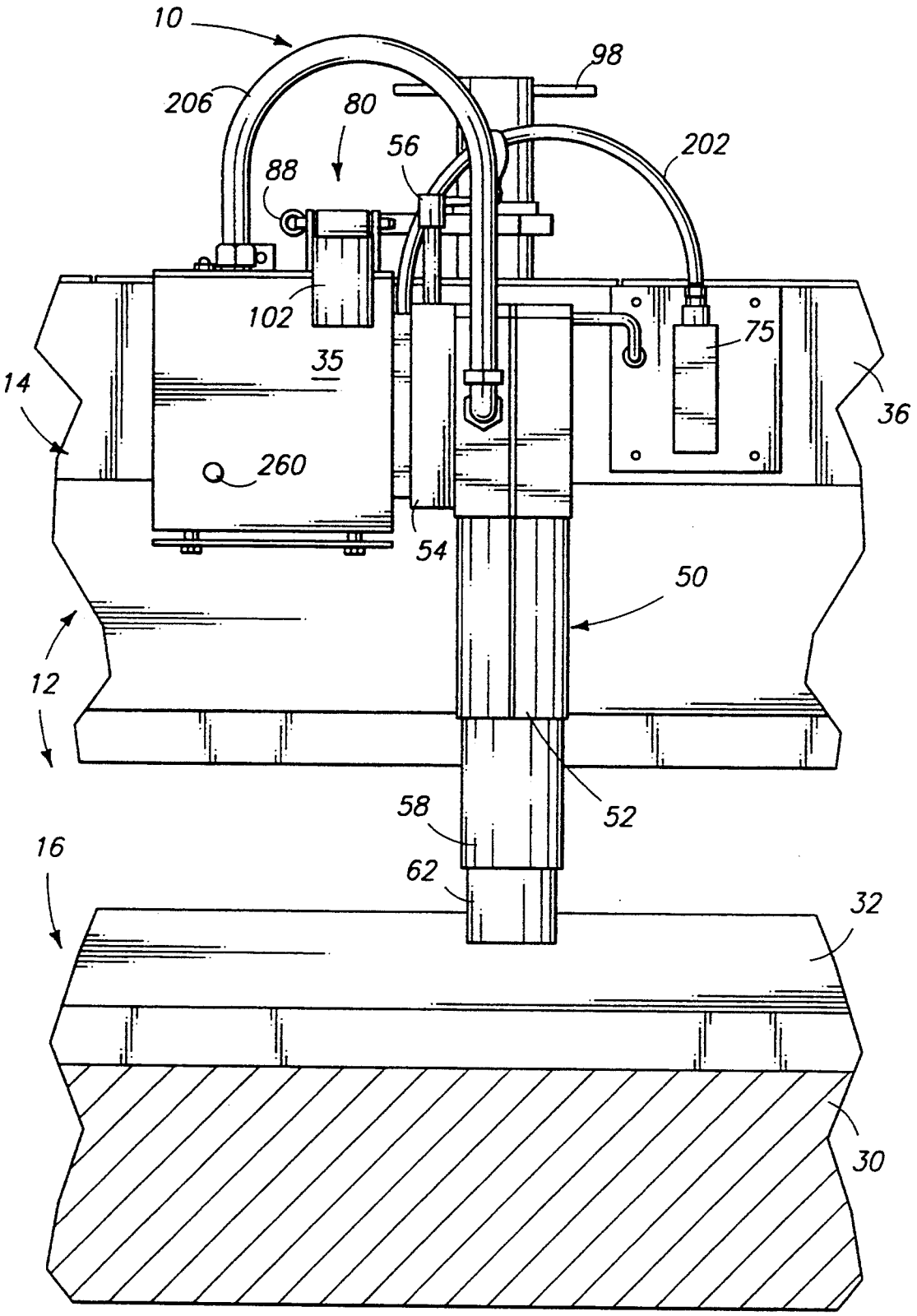
FIG. 2 is a front view of the semi-continuous metal casting system and metal casting control device of FIG. 1.

This disclosure of the invention is submitted in furtherance of the constitutional purposes of the U.S. Patent Laws "to promote the progress of science and useful arts." U.S. Constitution, Article 1, Section 8.

FIGS. 1–6 show a metal casting control device 10 in accordance with a preferred embodiment of the invention. Control device 10 is shown in conjunction with a direct-chill semi-continuous aluminum metal casting system, generally designated by the reference numeral 12. Metal casting system 12 includes an overhead molten metal distribution launder 14 and a plurality of underlying semi-continuous metal casting stations 16 (only one casting station is shown). The invention can also be used with other types of casting systems, such as electromagnetic casting systems.

Molten metal distribution launder 14 forms an open trough 18 spanning a number of metal casting stations 16. A tubular wireway 36 is mounted to and extends along the length of metal distribution launder 14. Trough 18 is lined with refractory materials 20 and contains molten metal during casting. A valved downspout 22 extends through the bottom of trough 18 above each casting station 16. Each downspout 22 has a tapered bore 23. A metal distribution control rod 24 is received within tapered bore 23 of downspout 22. Metal distribution control rod 24 is typically a cylindrical length of ceramic material, having a lower end which is approximately complementary in diameter to tapered bore 23. Downspout 22 and control rod 24 form a molten metal distribution control valve. Control rod 24 is vertically movable within the tapered bore of downspout 22 to control and regulate molten metal flow from distribution launder 14 to casting station 16. Control rod 24 is adapted to be connected at its upper end to a control mechanism such as will be described below.

Each metal casting station comprises a bottom block 30 and a mold 32. Molds 32 are mounted at a fixed elevation, while bottom blocks 30 are supported on a common table to be dropped in unison at a carefully controlled rate to form aluminum ingots of desired lengths. Molds 32 include water cooling means 34 for cooling and solidifying the aluminum as it is dropped through mold 32.

Metal casting control device 10 is removably mountable to the frame of launder 14 at a position over a casting mold 32, to measure and control the surface elevation of molten metal in the underlying casting station 16 during all phases of casting. More specifically, control device 10 includes a control device body 35, preferably formed by a rectangular enclosure. Control device body or enclosure 35 is removably attached over tubular wireway 36 by only a single quick-coupling or quick-couple mounting means 38. Quick-coupling 38 extends between control device 10 and the distribution launder of semi-continuous metal casting system 12 for mounting control device enclosure 35 to the supporting frame and for allowing quick replacement of control device 10.

Control device body or enclosure 35 forms a support and framework for various components associated with control device 10 while also providing a housing for control components. All components of control device 10 are mounted to or within control device enclosure 35. Thus, removal and replacement of control device enclosure 35 accomplishes removal and replacement of all control device components. Simple and convenient removal and replacement is facilitated by the quick-coupling 38.

FIG. 5 shows quick-coupling 38 in detail. It comprises a control device mounting flange 40 which extends laterally from control device enclosure 35. Control device mounting flange 40 is removably received over wireway 36 of semi-continuous casting system 12 to allow control device 10 to be lifted from the semi-continuous metal casting system 12. Guide pins 42 extend upward from wireway 36, to be received within complementary sized and located guide holes in mounting flange 40. In addition, a locking stud 44 extends upward from wireway 36 between guide pins 42, to be received through a corresponding aperture in mounting flange 40. A pair of locking tabs 46 extend upward from mounting flange 40 adjacent opposed sides of locking stud 44. A removable lock pin 48 is received by quick-coupling 38, more specifically through locking tabs 46 and locking stud 44.

Quick-coupling 38 forms a hanger to support control device enclosure 35 along the front side of metal distribution launder 14. Removable lock pin 48 forms a releasable lock which secures the control device enclosure to the overhead molten metal launder of the semi-continuous metal casting system. Manipulating the releasable lock by removing lock pin 48 frees control device enclosure 35 from the semi-continuous metal casting system, thereby allowing the control device to removed from the overhead metal launder.

Control device 10 includes a non-contact molten metal level sensing device 50 to measure molten metal surface elevation in the underlying casting mold 32 and to produce a corresponding molten metal surface elevation signal. Metal level sensing device 50 extends from control device enclosure 35 over casting mold 32. It comprises a sensor base or carriage 52, formed by a vertically-oriented tube or cylinder. Sensor carriage 52 is movably supported on control device enclosure 35 over underlying casting station 16 at an adjustable elevation by a sensor mount or calibration mount 54. Calibration mount 54 allows for manually-controllable elevation adjustment of metal level sensing device 50 relative to control device enclosure 35. The purpose of this manual adjustment is to calibrate metal level sensing device 50, as will be explained in more detail below. Calibration mount 54 comprises a linear slide having a manually-operated adjustment crank 56 to move metal level sensing device 50 up and down relative to the components of metal casting system 12.

Figure 6:
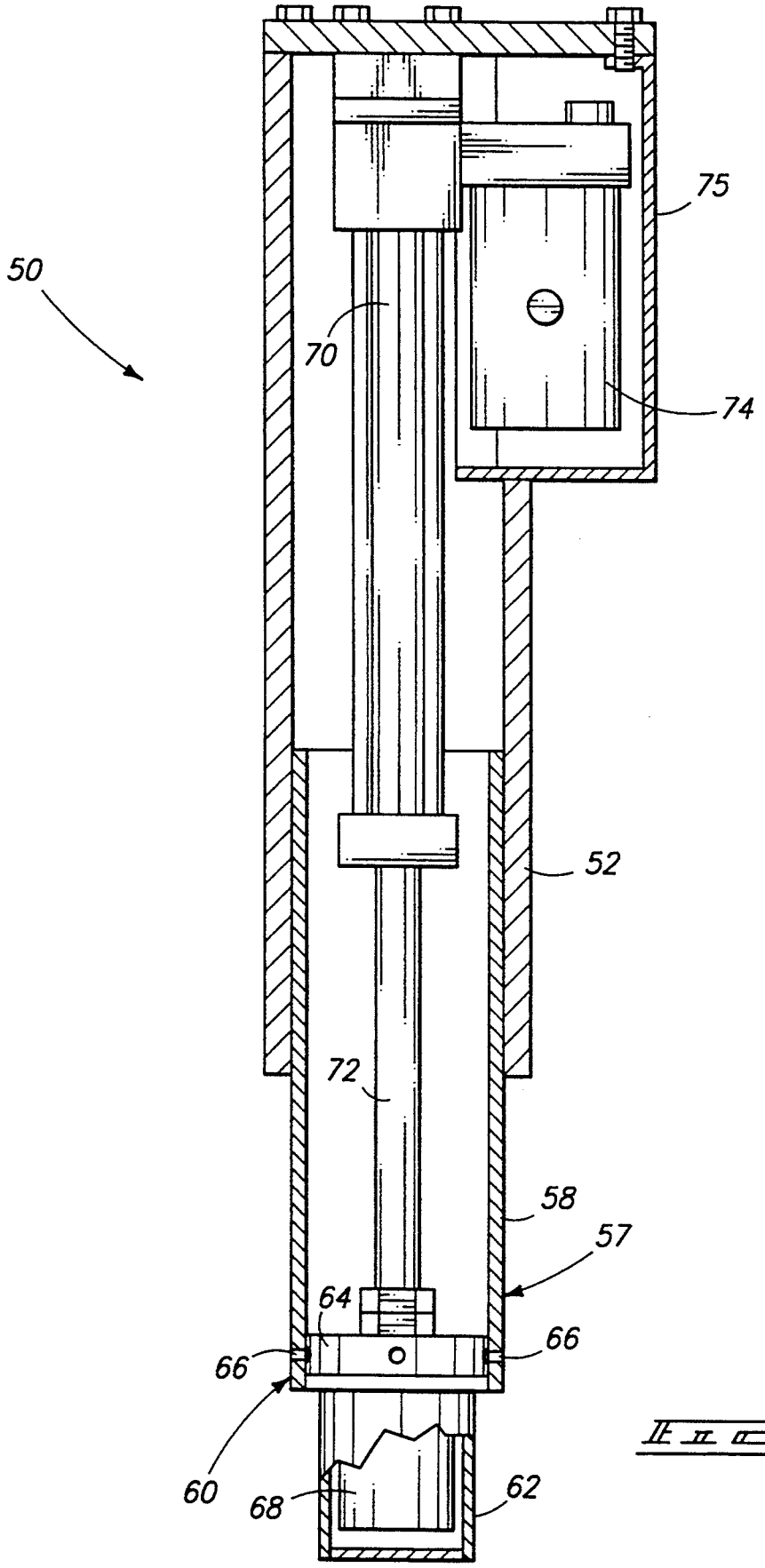
FIG. 6 is a sectional view of a non-contact metal level sensing device associated with the metal casting control device of FIG. 1.

Metal level sensing device 50 also includes a sensor support 57 which is received by sensor carriage 52 for controllable linear movement relative thereto (FIG. 6). Sensor support 57 is formed by a disk-shaped retainer 64 and by a cylindrical protective shroud 58. Shroud 58 and the cylinder which forms sensor carriage 52 have approximately complementary outer and inner diameters, respectively, resulting in a sliding or telescoping fit between the two components.

Sensor support 57 has a lower end 60 at which a sensor cup or refractory shield 62 is positioned. Refractory shield 62 extends downward from sensor support 57 toward the molten metal in casting station 16. It is cylindrical in shape, having a closed bottom and an open top. It is secured by a suitable adhesive to disk-shaped retainer 64, which is in turn pinned or riveted within the lower end of shroud 58.

An inductive proximity sensor 68 is also adhesively secured to retainer 64 within the refractory shield 62. Suitable inductive proximity sensors are available from Kaman Instrumentation Corporation of Colorado Springs, Colo. (KD-2300 Series). Proximity sensor 68 is directed downward so that it is responsive to vertical distance between sensor support 57 and the surface of any molten metal in the underlying casting station 16. An annular air space is provided between sensor 68 and refractory shield 62 to allow cooling of sensor 68. Inductive proximity sensor 68 is furnished with electronic control and amplifier components (not shown) to produce an analog proximity or displacement signal. These components are housed within control device enclosure 35.

An inductive proximity sensor in this operating environment is superior to other types of sensors used in the past, such as float sensors, optical sensors, or capacitive sensors. One advantage of an inductive proximity sensor is its extreme ruggedness and ability to withstand high temperatures. Another advantage is that its measurements are not affected by non-conducting materials. For instance, skimmers are often used on the surface of molten aluminum to contain oxides generated during the casting process. These skimmers are normally made from non-conducting refractory materials. Accordingly, such skimmers do not affect molten metal surface measurements made by an inductive proximity sensor. In addition, smoke and steam, often encountered in the casting process, do not affect inductive proximity sensors. An inductive displacement sensor is also preferable to a mechanical device such as a float. Float sensors are susceptible to producing control oscillations as they bounce on top of molten metal. Floats also often suffer from stiction, which reduces their responsiveness to small variations in molten metal levels.

A sensor actuator 70 is connected to adjust and control the height of sensor 68 and sensor support 57 relative to sensor carriage 52 and to the components of casting system 12. Sensor actuator 70 is a linear actuator which includes potentiometer position feedback. Sensor actuator 70 is mounted within carriage 52 to extend downward from the top of carriage 52. It has an extendible shaft 72 which connects to retainer 64. Sensor actuator 70 is powered by an integral bi-directional sensor drive motor 74 to move sensor support 57 up and down relative to carriage 52 and enclosure 35. An enlarged motor housing 75 is provided in the top of carriage 52 to accommodate motor 74. Sensor actuator 70 has a stroke of about eight inches (20 cm).

Figure 3:
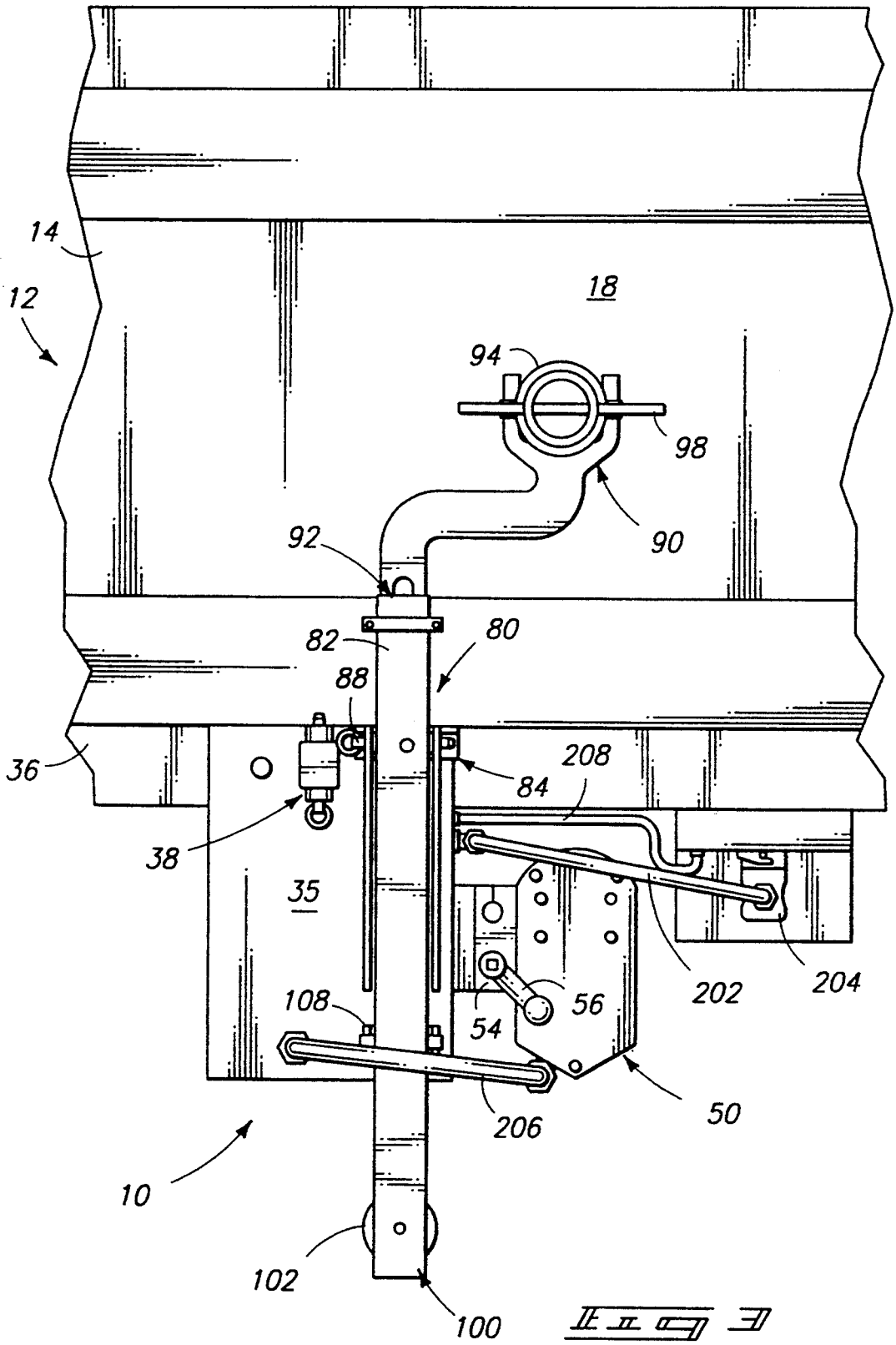
FIG. 3 is a top view of the semi-continuous metal casting system and metal casting control device of FIG. 1.
Figure 4:
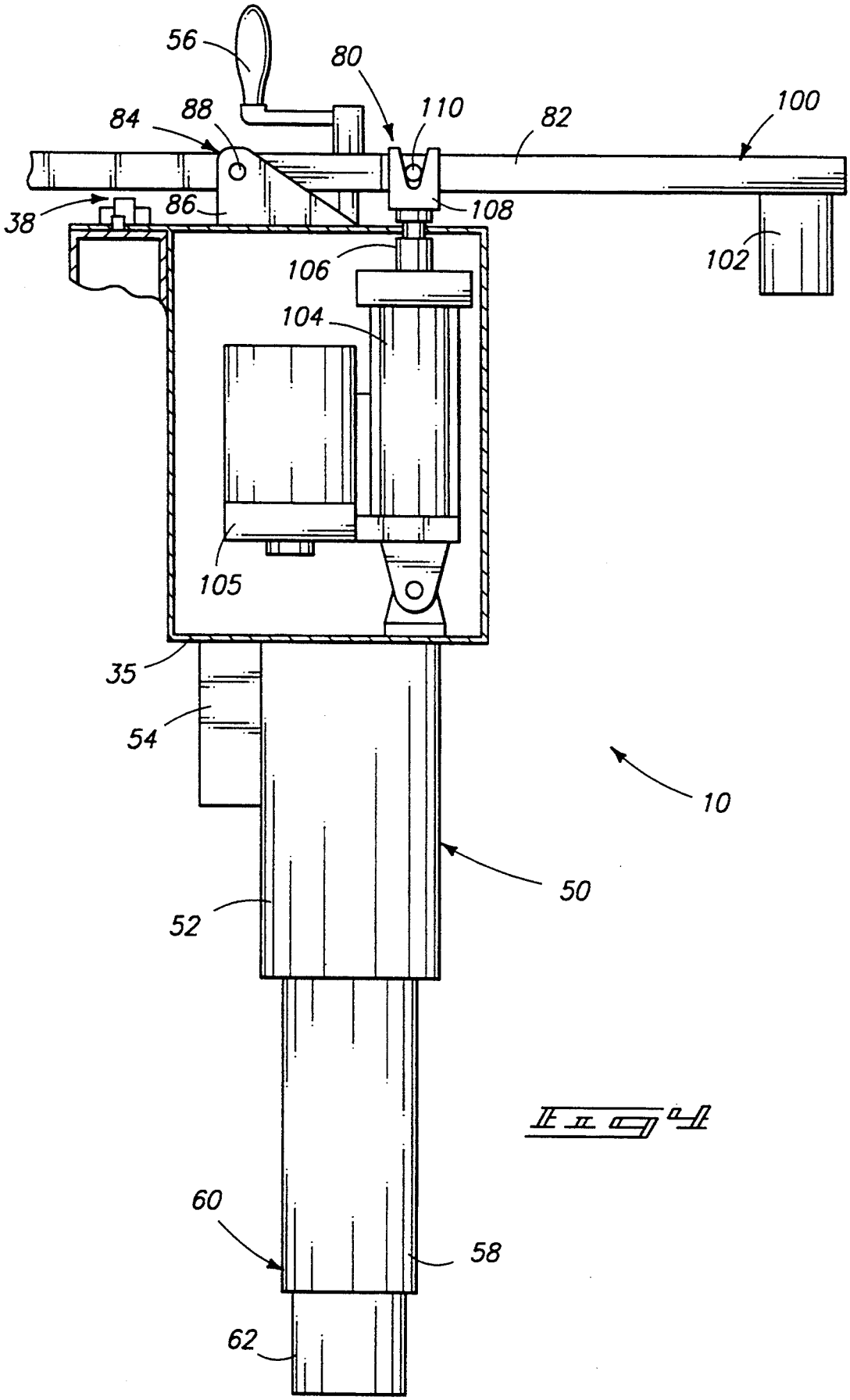
FIG. 4 is a side view of the metal casting control device of FIG. 1, with an enclosure cover removed to show internal components.
Figure 11:
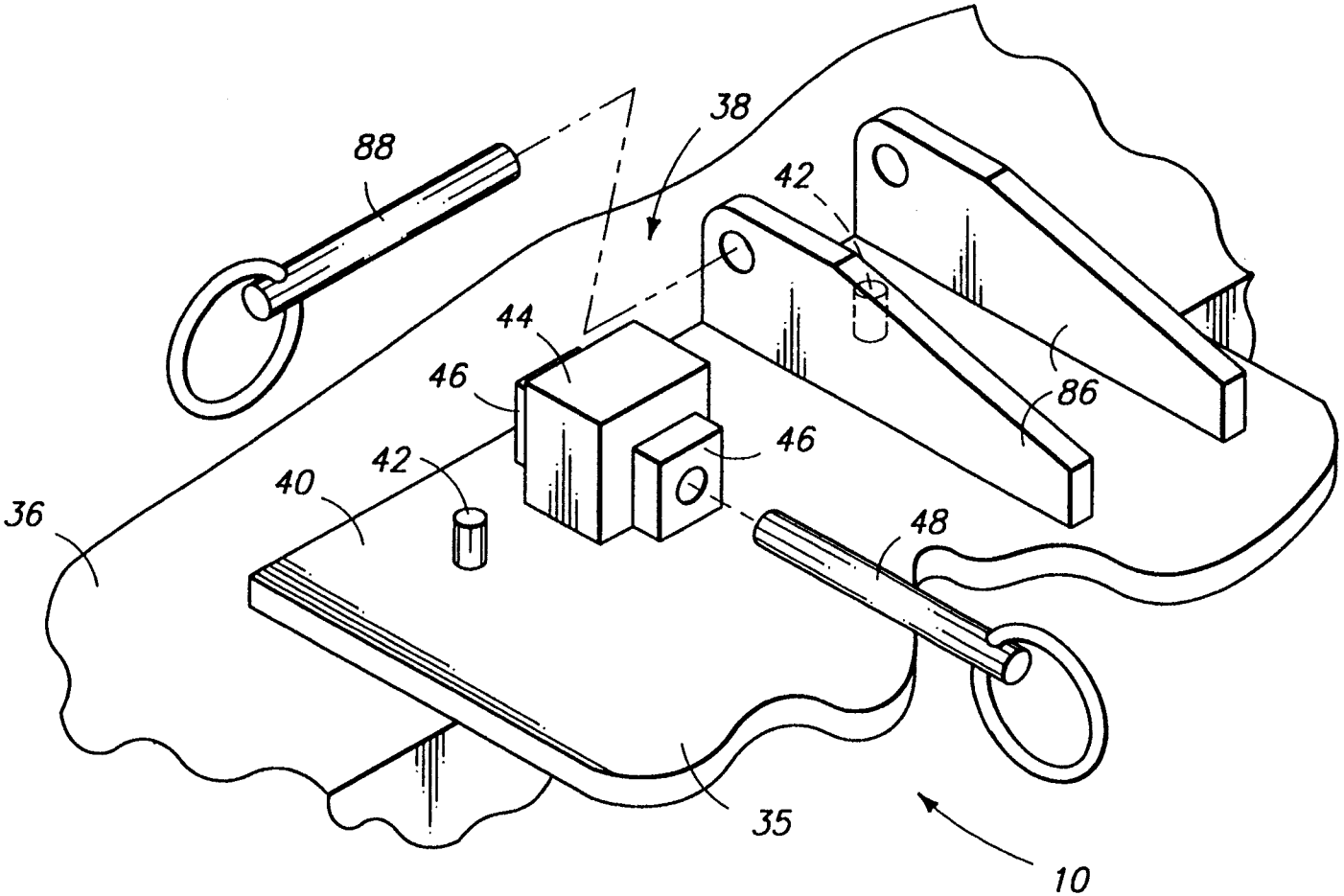

In addition to the components described above, control device 10 includes a valve actuator 80, best shown by FIGS. 3 and 4. Valve actuator 80 is mounted to control device enclosure 35 and is operably connectable to the metal distribution control valve of casting system 12. Valve actuator 80 comprises a control arm 82 which extends generally horizontally from control device enclosure 35 to control rod 24 of the metal distribution control valve. Control arm 82 is connected to control device 10 by a pivotal mount 84 atop control device enclosure 35. Pivotal mount 84 comprises a pair of parallel upright flanges 86 (FIG. 5) which are spaced from each other by slightly more than the width of control arm 82. A removable arm pivot pin 88 is received through flanges 86 and through control arm 82 to pivotally mount control arm 82 to control device enclosure 35.

Control arm 82 extends to a distal end 90 directly over downspout 22. Transverse alignment of distal end 90 relative to distribution launder 14 is facilitated by a sliding or telescoping joint 92 provided in control arm 82 between pivot mount 84 and distal end 90. Distal end 90 is threaded to receive a control rod sleeve 94. Control rod 24 is received within control rod sleeve 94 and held therein by a retainer pin 96. A handle 98 allows manual rotation of control rod sleeve 94 within distal end 90 to adjust the vertical relationship between control rod 24 and control arm 82.

Control arm 82 has a proximal end 100 which extends opposite pivotal mount 84 from distal end 90. A brass counterweight 102 is attached to proximal end 100 of control arm 82.

A control arm actuator 104 is mounted within control device enclosure 35. Control arm actuator 104 is a linear actuator with an integral bi-directional drive motor 105 and potentiometer position feedback. It is pivotally mounted at its lower end within control device enclosure 35, having an extendible shaft 106 which extends upward through the upper wall of control device enclosure 35 beneath control arm 82. A control arm cradle 108 is mounted to the upper end of extendible shaft 106 so that it extends from control arm actuator 104 directly beneath control arm 82 at a point between pivotal mount 84 and proximal end 100. A cradle pivot pin 110 extends through control arm 82 at this point. Control arm cradle 108 receives cradle pivot pin 110 of control arm 82 to pivot control arm 82 and to thereby position the metal distribution control valve.

Figure 7:
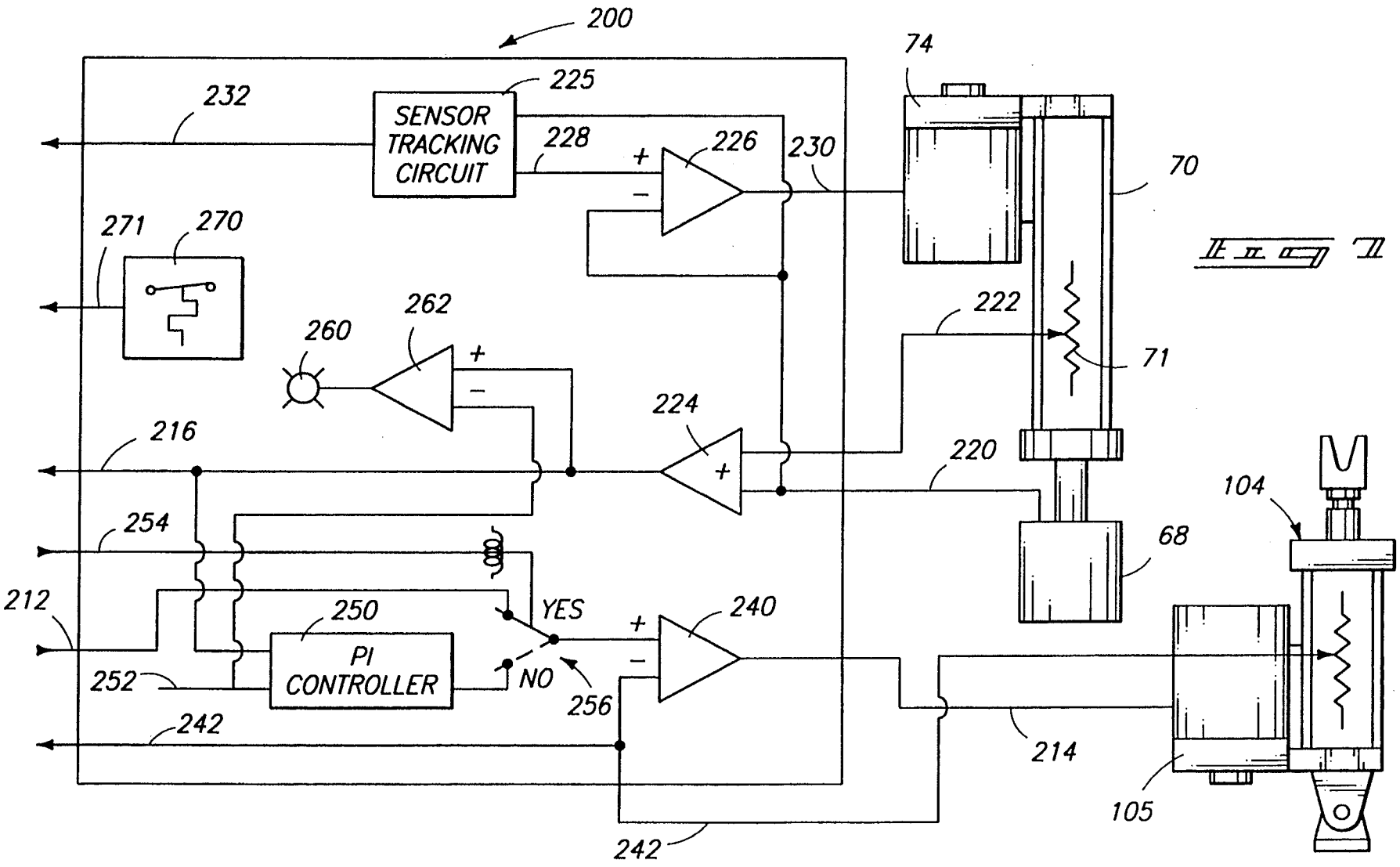
FIG. 7 is a schematic diagram of an electronic control circuit associated with the metal casting control device of FIG. 1.

An electronic control circuit 200 is housed within control device enclosure 35. Control circuit 200 is shown in simplified schematic form in FIG. 7. Control circuit 200 is implemented with analog circuitry, although digital or computerized circuits could also advantageously be substituted. Appropriate electrical connections to an external computer or programmable logic controller (PLC) are accomplished through conductors (not shown) in a flexible conduit 202 through an industrial multi-pin connector 204 and through additional conductors (not shown) extending through wireway 36 to the external PLC. A flexible conduit 206 extends between control device enclosure 35 and metal level sensing device 50 to provide appropriate electrical connections therebetween.

In addition to the electrical connections, control device 10 is connected to a source of pressurized air through a first air tube 208 which extends from a quick-disconnect at wireway 36 to control device enclosure 35. The pressurized air maintains a positive pressure within control device enclosure 35 to prevent or limit entry of foreign materials and gases into control device enclosure 35. It also cools the components within control device enclosure 35. A second air tube (not shown) extends between control device enclosure 35 and metal level sensing device 50 so that metal level sensing device 50 is also pressurized and cooled. In addition, pressurized air is constantly introduced into the space between proximity sensor 68 and refractory shield 62 to cool the sensor 68.

Control circuit 200 is responsive to an externally-supplied valve position command signal 212 to position the metal distribution control valve of casting system 12 through valve actuator 80. Valve actuator 80 is responsive to control circuit 200 through a valve actuator command signal 214 to motor 105 of control arm actuator 104.

Control circuit 200 also produces a molten metal surface elevation feedback signal 216 which corresponds to the measured surface elevation of molten metal in the underlying casting station 16. The molten metal surface elevation signal is supplied to the external PLC (not shown). The PLC implements a proportional-integral-derivative (PID) feedback control, based upon the value of molten metal surface elevation signal 216, to set the correct value of valve position command signal 212, and to thereby set the height of control rod 24.

Both molten metal surface elevation signal 216 and valve position command signal 212 have analog electrical characteristics which are compatible with industry-accepted standards, such as 0–10 volts or 4–20 milliamperes. Alternatively, these and other signals associated with control device 10 could be single or multi-bit digital signals.

To produce molten metal surface elevation signal 216, control circuit 200 receives a proximity feedback signal 220 from inductive proximity sensor 68, and a sensor height feedback signal 222 from the feedback potentiometer of sensor actuator 70, which is labeled 71 and is also referred to as a position sensor. Proximity signal 220 indicates the vertical distance measured between proximity sensor 68 and the molten metal surface within metal casting station 16. Sensor height signal 222 indicates the vertical position of sensor support 57 and proximity sensor 68 relative to sensor carriage 52 and to the components of casting system 12.

Control circuit 200 includes a signal processing device which receives the proximity signal and the sensor height signal and produces molten metal surface elevation signal 216 as a function of the proximity signal and the sensor height signal. The signal processing device in the preferred embodiment is an adder 224 which receives and adds proximity signal 220 and sensor height signal 222 to produce molten metal surface elevation signal 216, representing the surface elevation of underlying molten metal.

Control circuit 200 includes a sensor height control circuit which receives proximity signal 220 from the inductive proximity sensor 68. The sensor height control circuit is operably connected to sensor actuator 70 to control the height of sensor support 57 in response to proximity signal 220 and to maintain the inductive proximity sensor within a fixed vertical distance from molten metal surfaces in underlying casting station 16. Controlling the height of proximity sensor 68 in this manner enhances its functional range of operation, since the sensor itself has a limited measuring range. Moving the sensor up and down to follow the elevation of molten metal surfaces allows it to be used over a range limited only by the range of sensor actuator 70. Normally a range of six to eight inches (15–20 cm) is required for casting aluminum ingot, but a much longer range could also be provided if needed. The sensor itself is maintained at all times within about 1.75 inches (4.5 cm) of the measured molten metal surface, plus or minus a sensor-height deadband as discussed below.

The sensor height control circuit is formed in the preferred embodiment by a sensor tracking circuit 225 and a dead-band comparator 226. Dead-band comparator 226 receives proximity signal 220 from proximity sensor 68, as well as a sensor offset reference signal 228 produced by sensor tracking circuit 225. Sensor offset reference signal 228 corresponds to an optimum distance between sensor 68 and the underlying molten metal. Comparator 226 produces a sensor position command signal 230 which is connected to motor 74 of sensor actuator 70 to move sensor support 57 either up or down. Comparator 226 compares proximity signal 220 to determine whether it is within a predetermined sensor height dead-band of sensor offset reference signal 228. If it is not, comparator 226 moves sensor support 57 up or down to bring proximity signal 220 within the predetermined dead-band of sensor offset reference signal 228. The predetermined dead-band corresponds to about +/−0.1 inches (0.25 cm) of vertical sensor movement. Since proximity signal 220 and sensor height signal 222 are summed by adder 224, no loss of accuracy results over the entire measuring range.

Sensor tracking circuit 225 receives proximity signal 220 and compares it to sensor offset reference signal 228 to ensure that sensor support 57 is maintained within the prescribed distance from the underlying molten metal. Sensor tracking circuit 225 produces a sensor tracking error signal 232 if the sensor height control circuit is unable to control the height of sensor support 57.

Actual positioning of metal distribution control rod 24 is accomplished by a valve control comparator 240 which receives both the externally-supplied valve position command signal 212 and a valve position feedback signal 242 from the feedback potentiometer of control arm actuator 104. Valve control comparator 240 produces valve actuator command signal 214 which drives control arm actuator 104 either up or down until the correct position is attained. Valve position feedback signal 242 is also supplied to the external PLC (not shown), so that the PLC can verify that control device 10 is following the commands of the PLC.

Control circuit 200 also includes a backup valve control circuit 250 which is operable upon loss of the externally-supplied valve position command signal 212 to maintain molten metal at a predetermined or default surface molten metal elevation in the underlying casting mold. This predetermined elevation is not necessarily an optimum elevation for casting, and is not necessarily the elevation at which molten metal would be maintained by the PLC. It is merely a default elevation for use in case the PLC is unavailable to supply a more preferred molten metal elevation.

Backup valve control circuit 250 receives an internally-generated reference signal 252 which corresponds to the predetermined or default molten metal surface elevation. It also receives molten metal surface elevation signal 216 from adder 224. Backup valve control circuit 250 implements a proportional-integral (PI) feedback loop to control molten metal surface level in the absence of a valid valve position command signal 212.

To determine whether the external PLC is supplying a valid valve position command signal 212, control circuit 200 receives a PLC-operating signal 254 from the PLC to indicate that the PLC is functioning properly. PLC-operating signal 254 is connected to a relay or electronic switch 256 within control circuit 200. As long as PLC-operating signal 254 is active, switch 256 connects the externally-supplied valve position command signal 212 to valve control comparator 240. However, if PLC-operating signal 254 becomes inactive, indicating a PLC failure, switch 256 disconnects valve position command signal 212 from valve control comparator 240, and instead connects backup valve control circuit 250 to valve control comparator 240.

Control circuit 200 includes an over-temperature detection switch 270, which provides an over-temperature alarm signal 271 to the external PLC.

Figure 8:
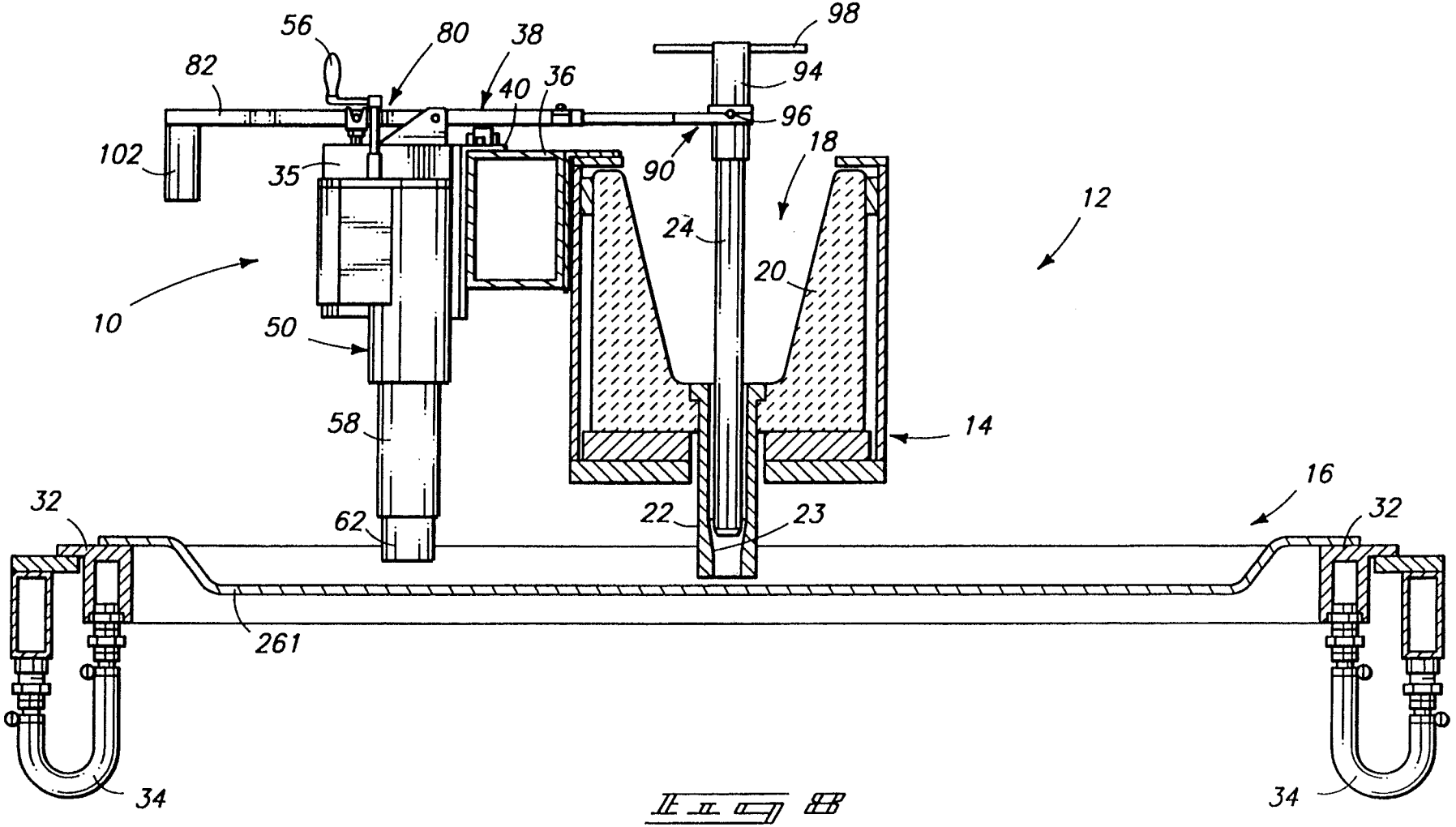
FIG. 8 is a front view of the semi-continuous metal casting system and metal casting control device of FIG. 1, also showing a calibration target for calibrating the metal casting control device.

Control circuit 200 further includes features for allowing simple vertical calibration of metal level sensing device 50. Such features include a calibration indicator 260 which is responsive to molten metal surface elevation signal 216 to indicate proper elevation calibration of metal level sensing device 50. To facilitate calibration, control device 10 includes a separate calibration target 261, as shown in FIG. 8, which is mountable relative to underlying casting station 16 at a reference molten metal surface elevation. The reference metal surface elevation can be any predetermined elevation, but is preferably a default elevation at which the molten metal surface should be maintained in the event of PLC failure. The reference metal surface elevation in the preferred embodiment is about two inches (5 cm) below the top of casting mold 32.

Calibration target 261 is a metal reference plate having an upper surface which simulates the presence of a molten metal surface in the underlying metal casting station at the reference molten metal surface elevation. The reference plate mounts across casting station 16 beneath metal level sensing device 50.

Calibration indicator 260 comprises a lamp or light-emitting diode (LED) mounted on control device enclosure 35. More preferably, calibration indicator 260 comprises a dual-color LED assembly which is responsive to alternative drive current directions to produce two different colors, such as green and red.

Calibration indicator 260 is driven by a calibration comparator 262 which is responsive to molten metal surface elevation signal 216 and to internally-generated reference signal 252. Reference signal 252 is set to equal a predetermined reference or "zero" value of the molten metal surface elevation signal, which in turn is defined to correspond to the surface elevation of calibration target 261. The reference value is preferably defined as a value corresponding to a 37.5% extension of sensor support 57. Calibration indicator 260 is responsive to calibration comparator 262 to indicate when molten metal surface elevation signal 216 and reference signal 252 are equal. This indicates proper vertical calibration of metal level sensing device 50, which occurs when the elevation adjustment of the sensor carriage results in the metal surface elevation signal being equal to the predetermined reference value. Calibration indicator 260 gives a first indication, for instance green, when the molten metal surface elevation signal is greater than the predetermined reference value, and gives a second indication, for instance red, when the molten metal surface elevation signal is less than the predetermined reference value. The signals are equal, corresponding to correct calibration, when the LED assembly flickers between red and green.

As described above, reference signal 252 serves two functions. First, it sets a default molten metal elevation, used in the case of PLC failure to control molten metal elevation at a safe level. Second, it provides a calibration reference for manual calibration of metal sensing device 50.

As described above, the control device forms an integrated module including metal level sensing device 50, valve actuator 80, and control circuit 200. In the event of a control device malfunction, the integrated module can be quickly and simply replaced as a whole, by simply releasing quick-coupling 38 and disconnecting the electrical and air connectors. Removing arm pivot pin 88 allows control arm 82 to be lifted from control device enclosure 35 and from control arm cradle 108 to allow replacement of control device 10.

All circuits in control device 10 can be factory-calibrated, or calibrated before installation. The only calibration required at actual installation is the vertical calibration of metal level sensing device 50. This is very simply accomplished by turning crank handle 56 and thereby moving metal level sensing device 50 vertically over a calibration target until the control device produces a molten metal surface elevation signal which equals the predetermined reference value, wherein the predetermined reference value corresponds to the elevation at which the upper surface calibration target rests. Neither electronic calibration nor software calibration are required during installation, greatly simplifying replacement of a control device.

Specific preferred vertical calibration methods in accordance with the invention and the description above therefore comprise mounting calibration target 261 to metal casting station 16 beneath metal casting control device 10 at the reference molten metal surface elevation. Metal level sensing device 50 produces molten metal surface elevation signal 216 in response to the vertical relationship between metal level sensing device 50 and calibration target 261, wherein a predetermined reference value of molten metal surface elevation signal 216 corresponds to the reference molten metal surface elevation when the metal casting control device is calibrated.

The preferred methods further include providing reference signal 252 which equals the predetermined reference value of molten metal surface elevation signal 216; comparing molten metal surface elevation signal 216 to reference signal 252, and indicating when molten metal surface elevation signal 216 and reference signal 252 are equal. Said indication is provided by illuminating a lamp or LED 260.

The only calibration step required of an operator is that of manually adjusting the elevation of molten metal level sensing device 50 by turning adjustment crank 56 until molten metal surface elevation signal 216 and reference signal 252 are equal, as indicated by the flickering of calibration indicator 260. When molten metal surface elevation signal 216 and reference signal 252 are equal, molten metal surface elevation signal 216 has a value which is understood by the external PLC to equal the reference molten metal surface elevation.

The invention described above provides solutions to the disadvantages which have resulted from automation of casting systems. To remedy a metal casting control device malfunction, the control device is simply replaced as a module-regardless of whether the malfunction relates to the molten metal surface sensing device, the valve actuator, or the electronic control circuits associated with the mechanical components. Removal and replacement is facilitated by the modular nature of the control device, as well as the quick-couple mechanism used to attach the control device to the metal casting system. Calibration of a newly-installed control device can be accomplished in seconds, by mounting or positioning a calibration plate and turning crank handle 56 to adjust metal level sensing device 50 vertically until the calibration indicator flickers between red and green. Calibration requires no reference to any external or remotely-located equipment such as a controlling PLC.

In compliance with the statute, the invention has been described in language more or less specific as to methodical features. It is to be understood, however, that the invention is not limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A non-contact molten metal level sensing device for measuring molten metal surface elevation in an underlying metal casting station, the metal level sensing device comprising:

a sensor base;

a proximity sensor which produces a proximity signal as a function of vertical distance between the proximity sensor and the surface of molten metal in an underlying casting station;

a sensor actuator operably connected between the proximity sensor and the sensor base to control the height of the proximity sensor;

a position sensor which produces a sensor height signal as a function of the height of the proximity sensor relative to the sensor base; and a signal processing device which receives the proximity signal and the sensor height signal and produces a molten metal surface elevation signal as a function of both the proximity signal and the sensor height signal.

2. A non-contact molten metal level sensing device as recited in claim 1, wherein the proximity sensor is an inductive proximity sensor.

3. In combination with a non-contact molten metal level sensing device as recited in claim 1:

a calibration mount which movably supports the sensor base at an adjustable elevation over the underlying casting station;

a calibration target which is mountable relative to the underlying casting station at a reference molten metal surface elevation, the calibration target having a surface which simulates the presence of molten metal in the underlying metal casting station at the reference molten metal surface elevation, wherein a predetermined reference value of the molten metal surface elevation signal corresponds to the reference molten metal surface elevation when the sensor base is vertically calibrated; and a calibration indicator which is responsive to the molten metal surface elevation signal to indicate when the elevation adjustment of the sensor base results in the metal elevation signal being equal to the predetermined reference value.

4. A non-contact molten metal level sensing device as recited in claim 1, and further comprising:

a sensor height control circuit which receives the proximity signal from the inductive proximity sensor;

the sensor height control circuit being operably connected to the sensor actuator to control the height of the proximity sensor in response to the proximity signal.

5. A non-contact molten metal level sensing device as recited in claim 1, and further comprising:

a sensor height control circuit which receives the proximity signal from the proximity sensor;

the sensor height control circuit being operably connected to the sensor actuator to maintain the proximity sensor within a fixed vertical distance from the molten metal surface in the underlying casting station.

6. A non-contact molten metal level sensing device as recited in claim 1, and further comprising:

a sensor height control circuit which receives the proximity signal from the proximity sensor;

the sensor height control circuit operably connected to the sensor actuator to control the height of the proximity sensor in response to the proximity signal;

the sensor height control circuit further including a sensor tracking circuit which produces an error signal if the sensor height control circuit is unable to control the height of the proximity sensor.

7. A non-contact molten metal level sensing device for measuring molten metal surface elevation in an underlying metal casting station, the metal level sensing device comprising:

a sensor base;

a sensor support mounted for controlled vertical movement relative to the sensor base, the sensor support including a downwardly-extending refractory shield;

a linear actuator operably connected between the sensor support and the sensor base to control the height of the sensor support;

a proximity sensor within the refractory shield, the proximity sensor producing a proximity signal as a function of vertical distance between the sensor support and the surface of molten metal within the underlying metal casting station;

a sensor height control circuit which receives the proximity signal from the proximity sensor, the sensor height control circuit being operably connected to the linear actuator to control the height of the sensor support in response to the proximity signal;

a position sensor which produces a sensor height signal as a function of the height of the sensor support relative to the sensor base; and a signal processing device which receives the proximity signal and the sensor height signal and produces a molten metal surface elevation signal as a function of both the proximity signal and the sensor height signal.

8. A non-contact molten metal level sensing device as recited in claim 1, wherein the signal processing device comprises an adder which sums the proximity signal and the sensor height signal to produce the molten metal surface elevation signal.

9. A non-contact molten metal level sensing device as recited in claim 1, further comprising:

a sensor height control circuit which receives the proximity signal from the proximity sensor;

the sensor height control circuit being operably connected to the sensor actuator to maintain the proximity sensor within a fixed vertical distance from the molten metal surface in the underlying casting station and to actuate the sensor actuator only when the distance between the proximity sensor and the underlying molten metal is not within a predetermined sensor height dead-band.

10. A non-contact molten metal level sensing device as recited in claim 7, wherein the signal processing device comprises an adder which sums the proximity signal and the sensor height signal to produce the molten metal surface elevation signal.

11. A non-contact molten metal level sensing device as recited in claim 7, the sensor height control circuit including a dead-band comparator operably connected to actuate the linear actuator only when the distance between the proximity sensor and the underlying molten metal is not within a predetermined sensor height dead-band.

12. A non-contact molten metal level sensing device as recited in claim 7, wherein the proximity sensor is an inductive proximity sensor.

13. In combination with a non-contact molten metal level sensing device as recited in claim 7:

a calibration mount which movably supports the sensor base at an adjustable elevation over the underlying casting station;

a calibration target which is mountable relative to the underlying casting station at a reference molten metal surface elevation, the calibration target simulating the presence of a molten metal surface in the underlying metal casting station at the reference molten metal surface elevation, wherein a predetermined reference value of the molten metal surface elevation signal corresponds to the reference molten metal surface elevation when the sensor base is vertically calibrated; and a calibration indicator which is responsive to the molten metal surface elevation signal to indicate when the elevation adjustment of the sensor base results in the metal elevation signal being equal to the predetermined reference value.

14. A non-contact molten metal level sensing device as recited in claim 7, wherein the sensor height control circuit is operably connected to the linear actuator to maintain the proximity sensor within a preselected minimum vertical distance from the molten metal in the underlying casting station.

15. A non-contact molten metal level sensing device as recited in claim 7, wherein the sensor height control circuit includes a sensor tracking circuit which produces an error signal if the sensor height control circuit is unable to maintain the proximity sensor within a preselected minimum vertical distance from the molten metal in the underlying casting station.

16. A non-contact metal casting control device for measuring and controlling molten metal surface elevation in a metal casting system, wherein the metal casting system includes a casting mold and a metal distribution control valve which is movable to control molten metal flow into the casting mold, the control device comprising:

a supporting fixed frame;

a control device body which is removably mountable to the frame at a location above the casting mold;

a non-contact metal level sensing device which extends downwardly from the control device body to measure molten metal surface elevation in the casting mold and to produce a corresponding molten metal surface elevation signal;

a valve actuator mounted to the control device body and operably connectable to the metal distribution control valve;

a control circuit within the control device body, the valve actuator being responsive to the control circuit, the control circuit being responsive to a control signal to position the metal distribution control valve;

wherein the metal level sensing device, the valve actuator, and the control circuit are integral with the control device body for removal as a single unit from the frame and;

further comprising quick-couple mounting means for mounting the control device body to the frame and for allowing quick replacement of the metal casting control device.

17. A non-contact metal casting control device as recited in claim 16, wherein the quick coupling mounting means comprises only a single quick-coupling which extends between the control device body and the metal casting system.

18. A non-contact metal casting control device as recited in claim 16, wherein:

the quick coupling mounting means comprises only a single quick-coupling which extends between the control device body and the metal casting system; and the quick-coupling includes a releasable lock which secures the control device body to the frame.

19. A non-contact metal casting control device as recited in claim 16, wherein:

the quick coupling mounting means comprises a control device mounting flange which extends from the control device body; and the control device mounting flange is removably received over the metal casting system to allow the metal casting control device to be lifted from the frame.

20. A non-contact metal casting control device as recited in claim 16, wherein:

the quick coupling mounting means comprises a control device mounting flange which extends from the control device body;

the control device mounting flange is removably received over the metal casting system to allow the metal casting control device to be lifted from the frame; and the metal casting control device further comprises a removable lock pin which secures the control device body to the frame, wherein removing the lock pin frees the control device body from the frame to allow the metal casting control device to be removed from the frame.

21. A non-contact metal casting control device as recited in claim 16, wherein the metal level sensing device is mounted for manually-controllable elevation adjustment relative to the control device body for calibrating the metal level sensing device relative to the casting mold.

22. A non-contact metal casting control device as recited in claim 16, wherein the control circuit includes a backup valve control circuit which is operable upon loss of the control signal to maintain molten metal at a predetermined elevation in the casting mold.

23. A non-contact metal casting control device as recited in claim 16, the valve actuator comprising:

a control arm which extends generally horizontally from the control device body to the metal distribution control valve;

a removable pivot pin which is received through the control arm to pivotally mount the control arm to the control device body;

a linear actuator mounted within the control device body;

a control arm cradle extending from the linear actuator, the control arm cradle receiving the control arm to pivot the control arm and to thereby position the metal distribution control valve;

wherein removing the pivot pin allows the control arm to be lifted from the control device body and from the control arm cradle, to allow replacement of the metal casting control device.

24. In combination with a non-contact metal casting control device as recited in claim 16:

a calibration mount which movably supports the metal level sensing device at a manually-controllable elevation;

a calibration target which is mountable relative to the casting mold at reference molten metal surface elevation; and a calibration indicator on the control device body, the calibration indicator being responsive to the molten metal surface elevation signal to indicate proper elevation calibration of the metal level sensing device.

25. A non-contact metal casting control device as recited in claim 16, wherein the metal level sensing device comprises:

a sensor base;

a sensor support which is mounted for vertical movement relative to the sensor base;

a sensor actuator operably connected between the sensor support and the sensor base to control the height of the sensor support; and a proximity sensor supported by the sensor support, the proximity sensor producing a proximity signal as a function of vertical distance between the sensor support and molten metal in the casting mold.

26. A non-contact metal casting control device as recited in claim 22, wherein the sensor base is mounted for manually-controllable elevation adjustment relative to the control device body for calibrating the metal level sensing relative to the casting mold.

27. A non-contact metal casting control device as recited in claim 25, wherein the control circuit includes a sensor height control circuit which receives the proximity signal from the proximity sensor, the sensor height control circuit being operably connected to the sensor actuator to control the height of the sensor support in response to the proximity signal.

28. A non-contact metal casting control device as recited in claim 25, wherein the control circuit produces the molten metal surface elevation signal in response to the proximity signal and to the height of the sensor support.

29. A non-contact metal casting control device for measuring and controlling molten metal surface elevation in a metal casting system, wherein the metal casting system includes a casting mold, an overhead molten metal launder, and a metal distribution control valve which is movable to control molten metal flow from the molten metal launder, the control device comprising:

a control device body;

a quick-coupling which extends from the control device body to be removably received by the overhead molten metal launder, the quick-coupling including a releasable lock which selectively secures the control device body to the overhead molten metal launder;

a non-contact metal level sensing device which extends from the control device body over the casting mold to produce a molten metal surface elevation signal;

a valve actuator mounted to the control device body and operably connectable to the metal distribution control valve; and a control circuit within the control device body, the valve actuator being responsive to the control circuit, the control circuit being responsive to a control signal to position the metal distribution control valve;

wherein the metal level sensing device, the valve actuator, and the control circuit are integral with the control device body for removal as a single unit from the overhead metal launder upon releasing the releasable lock of the quick-coupling.

30. A non-contact metal casting control device as recited in claim 29, wherein the releasable lock comprises a lock pin which is removably received by the quick-coupling.

31. A non-contact metal casting control device as recited in claim 29, wherein the metal level sensing device is mounted for manually-controllable elevation adjustment relative to the control device body for calibrating the metal level sensing device relative to the casting mold.

32. A non-contact metal casting control device as recited in claim 29, wherein the control circuit includes a backup valve control circuit which is operable upon loss of the control signal to maintain molten metal at a predetermined elevation in the casting mold.

33. A non-contact metal casting control device as recited in claim 29, the valve actuator comprising:

a control arm which extends generally horizontally from the control device body to the metal distribution control valve of the metal casting system;

a removable pivot pin which is received through the control arm to pivotally mount the control arm to the control device body;

a linear actuator mounted within the control device body; and a control arm cradle extending from the linear actuator, the control arm cradle receiving the control arm to pivot the control arm and to thereby position the metal distribution control valve;

wherein removing the pivot pin allows the control arm to be lifted from the control device body and from the control arm cradle to allow replacement of the metal casting control device.

34. In combination with a non-contact metal casting control device as recited in claim 29:

a calibration mount which movably supports the metal level sensing device at a manually-controllable elevation;

a calibration target which is mountable relative to the casting mold at a reference molten metal surface elevation; and a calibration indicator on the control device body, the calibration indicator being responsive to the molten metal surface elevation signal to indicate proper elevation calibration of the metal level sensing device.

35. A non-contact metal casting control device as recited in claim 29, wherein the metal level sensing device comprises:

a sensor base;

a sensor support which mounted for controlled vertical movement relative to the sensor base;

a linear actuator operably connected between the sensor support and the sensor base to control the height of the sensor support;

a proximity sensor supported by the sensor support, the proximity sensor producing a proximity signal as a function of vertical distance between the sensor support and the surface of molten metal in the casting mold;

the control circuit including a sensor height control circuit which receives the proximity signal from the proximity sensor, the sensor height control circuit being operably connected to the linear actuator to control the height of the sensor support in response to the proximity signal.

36. A non-contact metal casting control device as recited in claim 35, the metal level sensing device further comprising a calibration mount which movably supports the metal level sensing device at a manually-controllable elevation for calibrating the metal level sensing device relative to the casting mold.

37. A non-contact metal casting control device as recited in claim 35, wherein the control circuit produces the molten metal surface elevation signal in response to the proximity signal and to the height of the sensor support.

38. A metal casting control system for measuring molten metal surface elevation in an underlying metal casting station, comprising:

a metal level sensing device which produces a molten metal surface elevation signal;

a calibration mount which movably supports the metal level sensing device at an adjustable elevation;

a calibration target which is mountable relative to the casting station at a reference molten metal surface elevation, the calibration target simulating the presence of a molten metal surface in the metal casting station at the reference molten metal surface elevation, wherein a predetermined reference value of the molten metal surface elevation signal corresponds to the reference molten metal surface elevation when the metal casting control system is calibrated; and a calibration indicator responsive to the molten metal surface elevation signal to indicate when the elevation adjustment of the metal level sensing device results in the metal elevation signal being equal to the predetermined reference value.

39. A metal casting control system as recited in claim 38, further comprising:

a comparator which is responsive to the molten metal surface elevation signal and to a reference signal equal to the predetermined reference value, the calibration indicator being responsive to the comparator to indicate when the molten metal surface elevation signal and the reference signal are equal.

40. A metal casting control system as recited in claim 38, wherein the calibration target comprises a metal reference plate which mounts across the underlying metal casting station beneath the metal level sensing device at the reference molten metal surface elevation.

41. A metal casting control system as recited in claim 38, wherein the calibration indicator comprises a lamp mounted on the metal casting control device.

42. A metal casting control system as recited in claim 38, wherein the calibration indicator gives a first indication when the molten metal surface elevation signal is greater than the predetermined reference value and a second indication when the molten metal surface elevation signal is less than the predetermined reference value.

43. A metal casting control system as recited in claim 38, wherein the metal level sensing device produces a proximity signal and a sensor height signal, the control system further comprising an adder which sums the proximity signal and the sensor height signal to produce the molten metal surface elevation signal.

44. A metal casting control system for measuring molten metal surface elevation in an underlying metal casting station, the control system comprising:

a reference plate which is mountable relative to the casting station at a reference molten metal surface elevation, the reference plate simulating the presence of a molten metal surface in the metal casting station at the reference molten metal surface elevation;

a metal level sensing device which produces a molten metal surface elevation signal in response to the vertical relationship between the metal level sensing device and the reference plate, wherein a predetermined reference value of the molten metal surface elevation signal corresponds to the reference molten metal surface elevation when the metal casting control system is calibrated;

a calibration mount which movably supports the metal level sensing device at a manually-adjustable elevation above the metal casting station;

a comparator which is responsive to the molten metal surface elevation signal and to a reference signal equal to the predetermined reference value; and a calibration indicator which is responsive to the comparator to indicate when the elevation adjustment of the metal level sensing device results in the molten metal surface elevation signal and the reference signal being equal.

45. A metal casting control system as recited in claim 44, wherein the calibration indicator comprises a lamp mounted with the metal level sensing device.

46. A metal casting control system as recited in claim 44, wherein the calibration indicator gives a first indication when the molten metal surface elevation signal is greater than the reference signal, and gives a second indication when the molten metal surface elevation signal is less than the reference signal.

47. A metal casting control system as recited in claim 44, wherein the metal level sensing device produces a proximity signal and a sensor height signal, the control system further comprising a signal processing device which receives the proximity signal and the sensor height signal and produces a molten metal surface elevation signal as a function of the proximity signal and the sensor height signal.

48. A metal casting control system as recited in claim 44, wherein:

the metal level sensing device includes a sensor base and a proximity sensor, the proximity sensor being mounted for automatic vertical movement relative to the sensor base;

the metal level sensing device produces a proximity signal and a sensor height signal, the proximity signal being a function of vertical distance between the proximity sensor and the reference plate, the sensor height signal being a function of vertical position of the proximity sensor relative to the sensor base; and the metal casting control system further comprises an adder which sums the proximity signal and the sensor height signal to produce the molten metal surface elevation signal.

49. A method of calibrating a metal casting control device of a type which is mounted above an underlying metal casting station, and which includes a metal level sensing device to sense molten metal surface elevation in the underlying metal casting station, the method comprising the following steps:

mounting a calibration target beneath the metal casting control device at a reference molten metal surface elevation, the calibration target simulating the presence of a molten metal surface across the metal casting station at the reference molten metal surface elevation;

producing a molten metal surface elevation signal from the metal level sensing device; and manually adjusting the elevation of the metal level sensing device until the molten metal surface elevation signal equals a predetermined reference value corresponding to the reference molten metal surface elevation.

50. A method of calibrating a metal casting control device as recited in claim 49, the method further comprising:

providing a reference signal which equals the predetermined reference value; and indicating when the molten metal surface elevation signal and the reference signal are equal.

51. A method of calibrating a metal casting control device as recited in claim 49, the method further comprising:

providing a reference signal which equals the predetermined reference value; and wherein the step of manually adjusting the elevation of the metal level sensing device includes adjusting the elevation of the metal level sensing device until the molten metal surface elevation signal and the reference signal are equal.

52. A method of calibrating a metal casting control device as recited in claim 49, wherein the step of mounting the calibration target includes mounting a reference plate across the underlying metal casting station.

53. A method of calibrating a metal casting control device as recited in claim 49, the method further comprising illuminating a lamp mounted on the metal level sensing device to indicate when the molten metal surface elevation signal equals the predetermined reference value.

54. A method of calibrating a metal casting control device as recited in claim 49, the method further comprising the steps of:

indicating when the molten metal surface elevation signal is greater than the predetermined reference value;

indicating when the molten metal surface elevation signal is less than the predetermined reference value.

55. A method of calibrating a metal casting control device as recited in claim 49, wherein the step of producing the molten metal surface elevation signal comprises:

producing a proximity signal;

producing a sensor height signal;

summing the proximity signal and the sensor height signal to produce the molten metal surface elevation signal.

56. A method of calibrating a metal casting control device of a type which is mounted above an underlying metal casting station and which includes a metal level sensing device to sense molten metal surface elevation in the underlying metal casting station, the method comprising the following steps:

mounting a calibration target to the metal casting station beneath the metal casting control device at a reference molten metal surface elevation, the calibration target simulating the presence of a molten metal surface across the metal casting station at the reference molten metal surface elevation;

producing a molten metal surface elevation signal from the metal level sensing device in response to the vertical relationship between the metal level sensing device and the calibration target, a predetermined reference value of the molten metal surface elevation signal corresponding to the reference molten metal surface elevation when the metal casting control device is calibrated;

providing a reference signal, wherein the reference signal equals the predetermined reference value;

comparing the molten metal surface elevation signal to the reference signal;

manually adjusting the elevation of the metal level sensing device until the molten metal surface elevation signal and the reference signal are equal; and indicating when the molten metal surface elevation signal and the reference signal are equal.

57. A method of calibrating a metal casting control device as recited in claim 56, wherein the step of mounting the calibration target includes mounting a reference plate across the underlying metal casting station.

58. A method of calibrating a metal casting control device as recited in claim 56, wherein the indicating step includes illuminating a lamp which is mounted on the metal level sensing device.

59. A method of calibrating a metal casting control device as recited in claim 56, wherein the indicating step comprises the steps of:

indicating when the molten metal surface elevation signal is greater than the reference signal; and indicating when the molten metal surface elevation signal is less than the reference signal.

60. A method of calibrating a metal casting control device as recited in claim 56, wherein the step of producing the molten metal surface elevation signal comprises:

producing a proximity signal;

producing a sensor height signal;

summing the proximity signal and the sensor height signal to produce the molten metal surface elevation signal.

61. A method of calibrating a metal casting control device as recited in claim 56, wherein the step of producing the molten metal surface elevation signal comprises:

producing a proximity signal which indicates vertical distance between a proximity sensor and the calibration target, wherein the metal level sensing device includes a sensor base, the proximity sensor being mounted for automatic vertical movement relative to the sensor base;

producing a sensor height signal as a function of vertical position of the proximity sensor relative to the sensor base; and adding the proximity signal and the sensor height signal to produce the molten metal surface elevation signal.

* * * * *